US008629361B2

(12) United States Patent
Koyama et al.

(10) Patent No.: US 8,629,361 B2
(45) Date of Patent: Jan. 14, 2014

(54) SWITCH DEVICE

(75) Inventors: Katsuya Koyama, Okaville (CA); Takuya Eguchi, Nagoya (JP); Shinichi Togawa, Kasugai (JP)

(73) Assignee: Omron Automotive Electronics Co., Ltd., Aichi (JP)

( * ) Notice: Subject to any disclaimer, the term of this patent is extended or adjusted under 35 U.S.C. 154(b) by 136 days.

(21) Appl. No.: 13/414,207

(22) Filed: Mar. 7, 2012

(65) Prior Publication Data

US 2012/0228101 A1 Sep. 13, 2012

(30) Foreign Application Priority Data

Mar. 7, 2011 (JP) ..... 2011-049007

(51) Int. Cl.
*H01H 9/04* (2006.01)

(52) U.S. Cl.
USPC ..... 200/302.1

(58) Field of Classification Search
USPC ..... 200/302.1, 51 R, 341, 314; 439/206, 439/521, 519, 76.1
See application file for complete search history.

(56) References Cited

U.S. PATENT DOCUMENTS 5,824,981 A * 10/1998 Suzuki ..... 200/302.1
5,876,243 A 3/1999 Sangawa
6,443,644 B1 * 9/2002 Takeda et al. ..... 400/490
6,809,278 B2 * 10/2004 Tsubaki ..... 200/341
7,244,897 B2 * 7/2007 Villagrasa et al. ..... 200/61.85

FOREIGN PATENT DOCUMENTS

JP 8212874 A 8/1996
JP 9204842 A 8/1997
JP 2007097322 A 4/2007

OTHER PUBLICATIONS

English Patent Abstract of JP 2007-097322, Publication Date: Apr. 12, 2007 (1 Page).
English Patent Abstract of JP 8-212874, Publication Date: Aug. 20, 1996 (1 Page).

* cited by examiner

*Primary Examiner* — Edwin A. Leon
(74) *Attorney, Agent, or Firm* — Osha Liang LLP

(57) ABSTRACT

A switch device has a case, an operation knob disposed above the case, and a connector disposed under the case. The connector has connection terminals and a housing supporting the connection terminals, the housing being formed with an opening portion from which the connection terminals are led out. The case is provided with an impervious wall extending downward from the case so as to be opposed to both side surfaces of the housing parallel to a leading-out direction of the connection terminals. The impervious wall is arranged across a gap from each of the both side surfaces of the housing.

8 Claims, 18 Drawing Sheets

SWITCH DEVICE

BACKGROUND OF THE INVENTION

1. Technical Field

The present invention relates to a switch device that performs ON/OFF of a switch by operation of an operation knob, and particularly to a waterproof switch device that prevents water from coming into a connector.

2. Related Art

A vehicle such as an automobile includes a switch device to perform opening/closing control over windows, locking/unlocking control over doors or the like, and this type of switch device is generally provided in a door armrest, a center console or the like.

The above-described switch device includes, for example, a case 1', a cover 9' that covers an upper surface of the case 1', and operation knobs 81', as shown in 100' of FIG. 17.

In FIG. 17, arrow F indicates a front direction of the switch device 100'. Hereinafter, similarly, arrow B indicates a back direction, arrow R indicates a right direction, arrow L indicates a left direction, arrow U indicates an upper direction, and arrow D indicates a down direction. Thus, FIG. 17 is a side view when the switch device 100' is viewed from the left side.

The case 1' is made up of an upper case 2' opened downward, and a lower case 3' attached to the upper case 2' so as to shut this opening. Inside the case 1', electronic components such as a printed circuit board 71' and switches 72' are contained. A connector 5' is mounted on a lower surface of the printed circuit board 71'.

The connector 5' has a housing 6' and connection terminals 7' supported by this housing 6'. The lower case 3' is formed with an opening portion 33', and the connector 5' is fitted in this opening portion 33' to be attached to the printed circuit board 71' through the housing 6' and the connection terminals 7'.

The housing 6' has, at one end portion thereof, an opening portion 6*a*' made of a depressed portion. Also, in another end portion of the housing 6', a shielding wall 61' with through-holes 62' which the connection terminals 7' penetrate. One end portion 7*a*' of each of the connection terminals 7' is connected to the printed circuit board 71' by soldering. Another end portion of each of the connection terminals 7' is led out to the opening portion 6*a*' as a connection portion 7'*b* through the through-hole 62' formed in the shielding wall 61'.

In the opening portion 6*a*' of the housing 6' is fitted a connector (illustration is omitted) with a cable to connect to a control device not shown. This allows the connection portions 7*b*' of the connector 5' and connection portions (illustration is omitted) of the counterpart connector to be connected, thereby enabling output signals of the switches 72' to be transmitted from the switch device 100' to the control device.

Furthermore, an upper surface 21' of the upper case 2' is provided with tubular portions 26', each of which opens vertically to communicate with an inside of the case. The operation knob 81' is attached to each of these tubular portions 26' so as to cover an upper opening of the relevant tubular portion 26'. Each of the operation knob 81' is operably exposed from an opening portion 91' provided in the cover 9'.

In the above-described switch 100', when rainwater coming in through a window forgotten to close, drinkable water spilled from a container or the like (hereinafter, collectively referred to as "water") is poured on the cover 9', the relevant water flows down to the upper surface 21' of the upper case 2' through gaps between the opening portions 91' of the cover 9' and the operation knobs 81', and flows to the tubular portion 26' side.

The water flowing to the tubular portion 26' side, if an amount thereof is large, may go up through gaps between the operation knobs 81' and the tubular portions 26', and may come into the case 1' through the openings of the tubular portions 26'. The water coming into the case 1' will cause corrosion and a short circuit in the electronic components such as the printed circuit board 71' and the switches 72'.

Therefore, a groove portion 28' for drainage is provided in the vicinity of each of the tubular portions 26' to drain the water flowing down to the upper surface of the upper case 2' from the relevant groove portion 28'. The above-described groove portions 28' extend, for example, in right and left directions (R and L directions) of the case 1', and end portions on the side surface sides of the upper case 2' are opened. Accordingly, the water drained from the end portions of the groove portions 28' flows down on the side surfaces of the case 1' to be drained outside.

Here, when each of the above-described groove portions 28' is located above (in the U direction of) the connector 5', the water drained from the relevant groove portion 28' and flowing down on the side surface of the case 1' can flow to the connector 5' side along the side surface of the case 1'.

Furthermore, as a method for attaching the switch device, as shown in FIG. 17, the switch device is generally attached at an angle at which front and back directions F and B of the switch device 100' is substantially parallel to a floor surface of the vehicle, that is, the ground.

However, in recent years, from a request from a user, convenience of the operation and the like, a method of attaching the switch device 100' in a state where the front side thereof is inclined in the upper direction U at a predetermined angle (e.g., 20° to 30°) to the ground has begun to be employed (refer to FIG. 18).

Moreover, when the switch device 100' is horizontally attached, the switch device 100' is relatively inclined when the vehicle travels on a steep upslope.

In this manner, when the switch device 100' is inclined at a predetermined angle to the horizontal direction, the water flowing down on the side surfaces of the case 1' can flow to the connector 5' side along the side surfaces of the case 1', even in the case where the groove portions 28' are not provided above (in the U direction of) the connector 5'.

The water flowing to the connector 5' side will come into the connection portions 7'*b* from the opening portion 6*a*' of the housing 6', thereby causing corrosion and a short circuit inside the connector 5'.

On the other hand, in Japanese Patent Application Laid-Open Nos. 2007-97322, H9-204842, H8-212874, there have been proposed a switch device and the like in which means for preventing water from coming into a connector portion is taken.

For example, in the above-described Japanese Patent Application Laid-Open No. 2007-97322, a connector is included on a lower surface of a lower cover (a box body) of a relay block. In an inner bottom surface of this lower cover, an opening is formed. Moreover, a gap enabling water removal through the opening is assured between the lower cover and the connector. The water flowing into the lower cover is drained outside through the above-described opening and gap.

In Japanese Patent Application Laid-Open No. H9-204842, a connector is included in an end portion of a switch box. Moreover, in the switch box, there is provided a waterproof cover made up of eaves covering an upper part of the connector, an upper water stopping wall extending upwardly from a frontal edge of the eaves, and two side water stopping walls covering both sides of the connector. The water flowing onto an upper surface of the switch box is received by the eaves, and is then guided by the side water stopping walls and flows down along the side water stopping walls to be drained outside.

In Japanese Patent Application Laid-Open No. H8-212874, on a lower surface of a switch case, a connector is included. In this switch case, a hook formed in the connector is put into a snap fit hole formed in a case side surface, by which the connector is fixed to the case lower surface. Moreover, in a case upper surface provided with a switch knob, there is formed a water catching groove, and in the case side surface, a drainage port penetrating a deepest portion of the water catching groove, and a drainage guide that guides the water flowing out from the drainage port to cause the water to flow down. The water flowing onto the case upper surface is caught in the water catching groove, and is then drained by the drainage port and the drainage guide to a position deviating from the snap fit hole.

However, the structures described in Japanese Patent Application Laid-Open Nos. 2007-97322, H9-204842, H8-212874 are insufficient to prevent the water running along the side surfaces of the case from coming around into the connector from the opening portion of the connector, and more effective waterproof countermeasures are desired.

SUMMARY

One or more embodiments of the present invention provides a switch device that can prevent water from coming into a connector along side surfaces of a case.

In accordance with one or more embodiments of the present invention, there is provided a switch device including a case, an operation knob provided above the case, and a connector that is provided under the case, and has connection terminals and a housing supporting the connection terminals, the housing being formed with an opening portion from which the connection terminals are led out, wherein the case is provided with an impervious wall extending downward from the case so as to be opposed to both side surfaces of the housing parallel to a leading-out direction of the connection terminals, and the impervious wall is arranged across a gap from each of both the side surfaces of the housing.

With the above-described constitution, even if the water flowing down to an upper surface of the case flows along side surfaces of the case, this water drops along the impervious wall, and does not head for the connector. Moreover, since the impervious wall is arranged across the gap from each of both the side surfaces of the housing, coming around to the connector side of the water running along the impervious wall can be cut off by the gap. Accordingly, the water can be prevented from coming in from the opening portion of the connector, thereby causing corrosion and a short circuit inside the connector.

In one or more embodiments of the present invention, in order to suppress an increase in number of components and reduce assembling manhours, the impervious wall is formed integrally with the case.

In one or more embodiments of the present invention, when the case has an upper case opened downward, and a lower case attached to the upper case so as to shut the opening of the upper case, the impervious wall may be made up of extended portions resulting from extending both side surfaces of the upper case downward.

Moreover, in one or more embodiments of the present invention, when the case has an upper case opened downward, and a lower case attached to the upper case so as to shut the opening of the upper case, the impervious wall may be made up of a wall portion that is protruded downward from a lower surface of the lower case.

In this case, the wall portion may be made up of a first portion perpendicularly rising from the lower surface of the lower case, a second portion extending to a side surface side of the upper case parallel to the lower surface of the lower case from the first portion, and a third portion rising perpendicular to the lower surface of the lower case from an end portion on the side surface side of the second portion, and a side surface of the third portion may be on the same level of the side surface of the upper case.

Thereby, the side surface of the third portion of the wall portion becomes on the same level as the side surface of the upper case, and thus, when the wall portion as the impervious wall is provided in the lower case, the gaps comparable to the case where the side surfaces of the upper case are extended to make up the impervious wall can be assured between the both side surfaces of the housing of the connector, and the impervious wall.

In one or more embodiments of the present invention, the housing of the connector may have the opening portion in one end portion in the direction parallel to the lower surface of the case, and the impervious wall may be provided so as to encompass threes side surfaces of the housing excluding the opening portion.

This allows the three sides of the connector to be surrounded by the impervious wall, which can more effectively prevent the water from coming into the connector from the opening portion of the housing.

In one or more embodiments of the present invention, a groove portion for draining, to the side surface side of the case, water flowing down to the upper surface of the case may be provided in the upper surface of the case. In this case, the impervious wall is interposed between the groove portion and the connector.

Thus, even if the water is drained from the groove portion vigorously, the water is shielded by the impervious wall, which can impede the drained water from reaching the connector.

In one or more embodiments of the present invention, a position of a lower end of the impervious wall may be the same as, or lower than a position of a lower surface of the housing.

In this constitution, since the impervious wall extends beyond the lower end positions of the housing side surfaces, the water dropped along the impervious wall does not fall on the side surfaces of the housing, thereby increasing a waterproof effect of the connector. Moreover, when the position of the lower end of the impervious wall is on the same as the position of the lower surface of the housing, a height of the impervious wall can be suppressed while maintaining the waterproof effect of the connector, which leads to the downsizing of the switch device.

According to one or more embodiments of the present invention, the switch device that can prevent water from coming into the connector along the side surfaces of the case can be provided.

DETAILED DESCRIPTION

Figure 1:
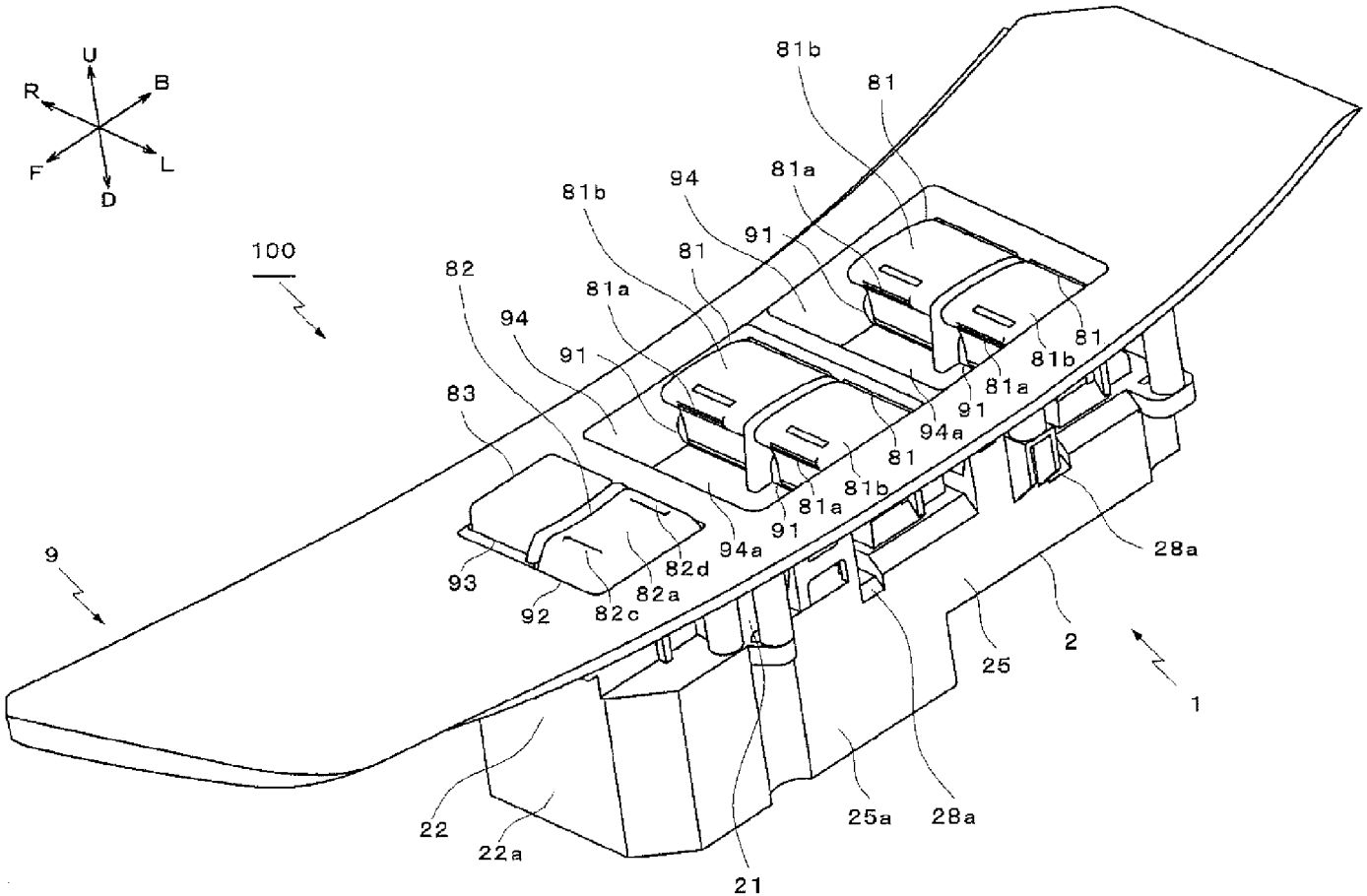
FIG. 1 is a perspective view when a switch device according to a first embodiment of the present invention is viewed from above.

First, a switch device 100 according to a first embodiment of the present invention will be described with reference to FIGS. 1 to 10. In the following drawings, the same reference numerals are given to the same portions or corresponding portions. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

In FIGS. 1 to 10, arrows U, D, F, B, R, L indicate upper, lower, front, back, right and left directions of the switch device 100, respectively.

The switch device 100 is used in a power window device, and is attached to, for example, an armrest (illustration is omitted) provided in a door of a driver seat of a vehicle. This switch device 100 includes a case 1, operation knobs 81 to 83, and a cover 9, as shown in FIG. 1.

Figure 2:
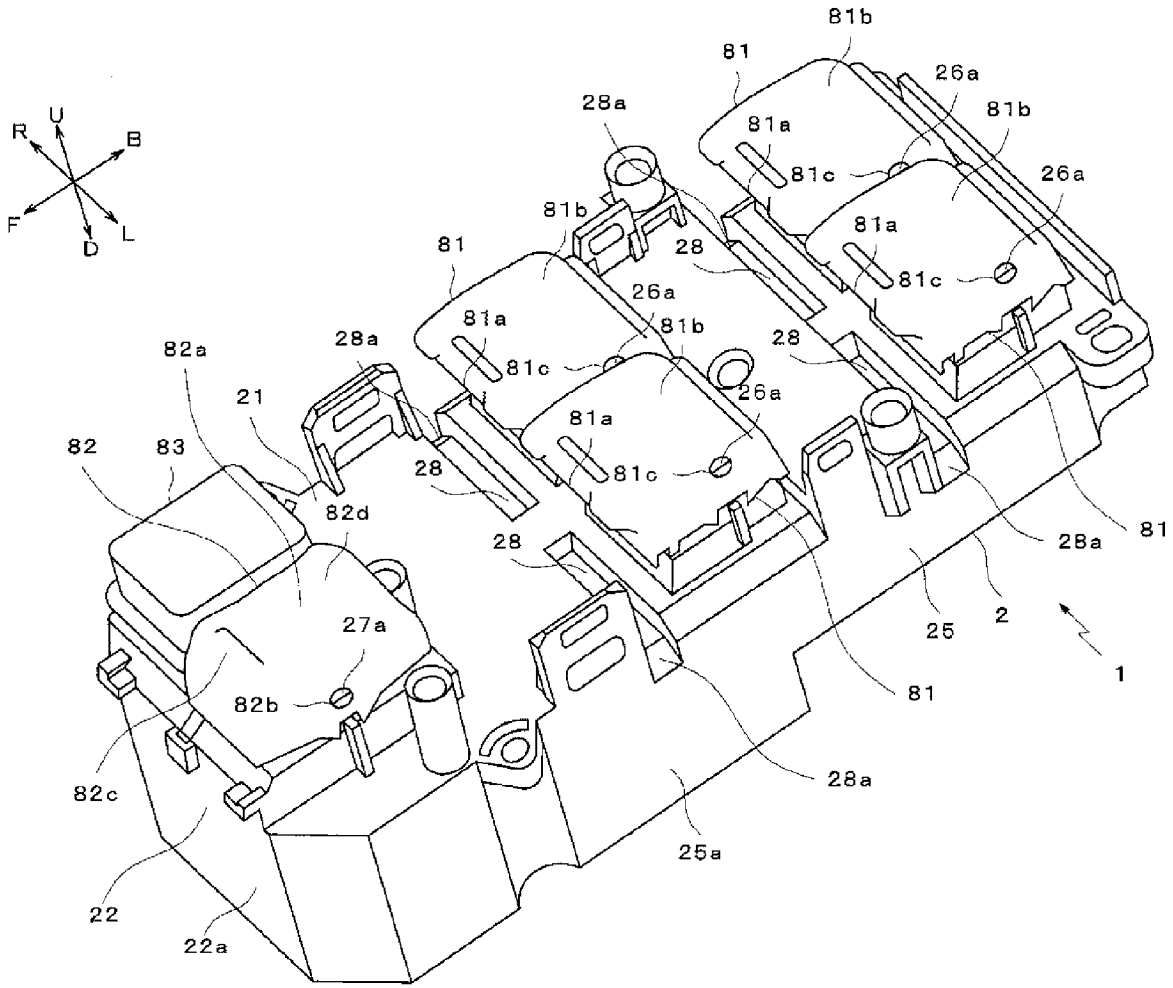
FIG. 2 is an external view of the switch device in a state where a cover is removed.

The case 1 is formed into a rectangular parallelepiped shape having a length in right and left directions (in R and L directions) shorter than a length in front and back directions (F and B directions), as shown in FIG. 2. The case 1 is made up of an upper case 2 opened downward, and a lower case 3 attached to the upper case 2 so as to shut this opening, as shown in FIG. 9.

Inside the case 1, electronic components such as a printed circuit board 71 and switches 72 are contained. A connector 5 described later is mounted on a lower surface of the printed circuit board 71.

Figure 3:
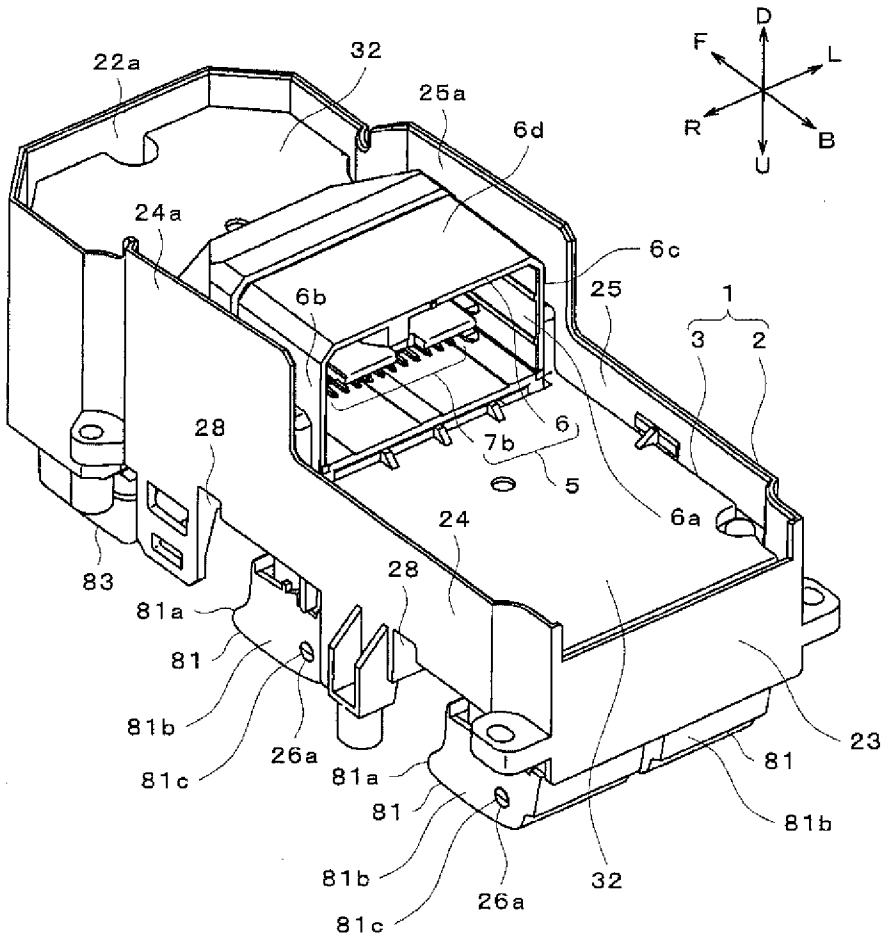
FIG. 3 is a perspective view when the switch device in FIG. 2 is viewed from beneath.

As shown in FIGS. 2 and 3, the upper case 2 has an upper surface 21, a front surface 22, a back surface 23, a right side surface 24 and a left side surface 25.

Figure 9:
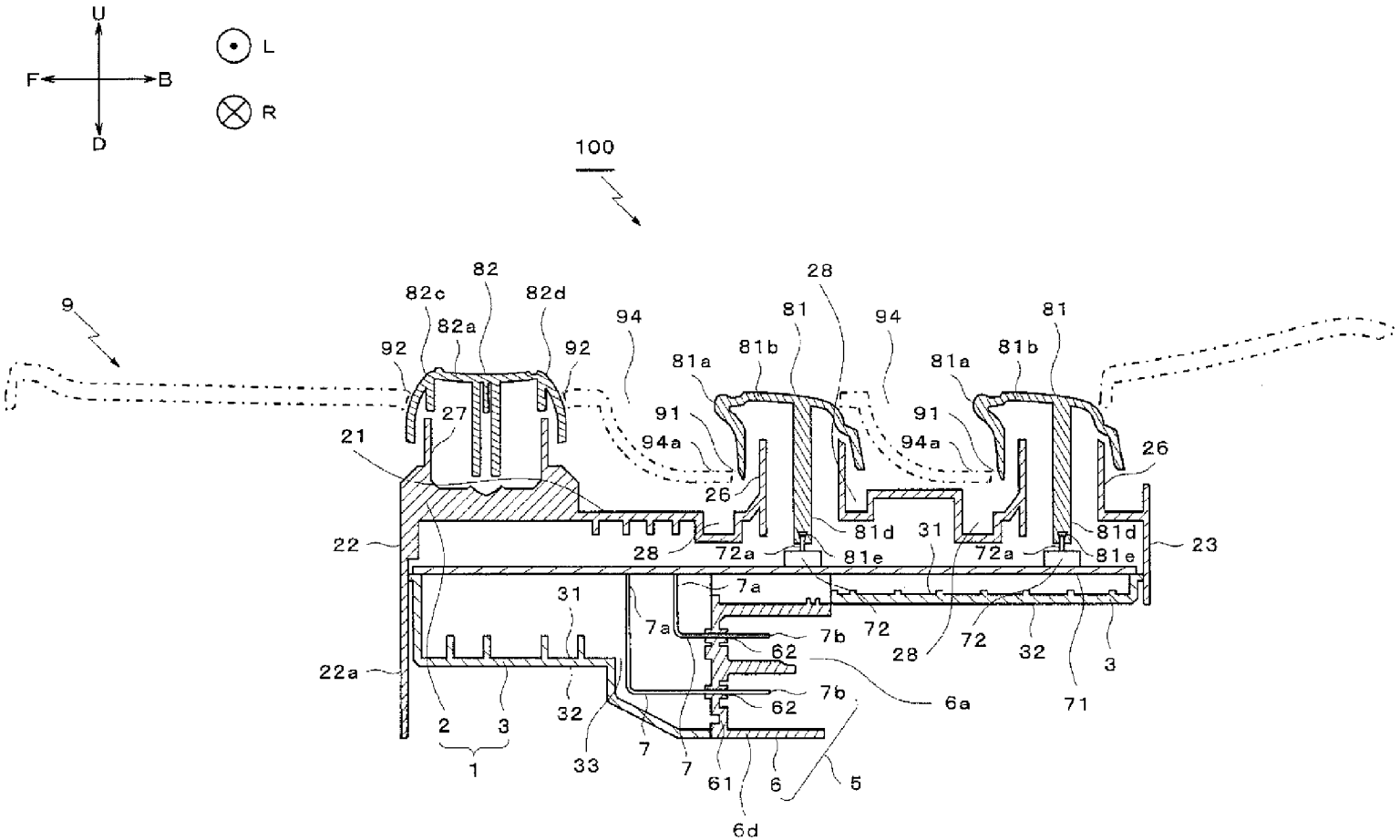
FIG. 9 is a lateral cross-sectional view of the switch device in FIG. 1.
Figure 10:
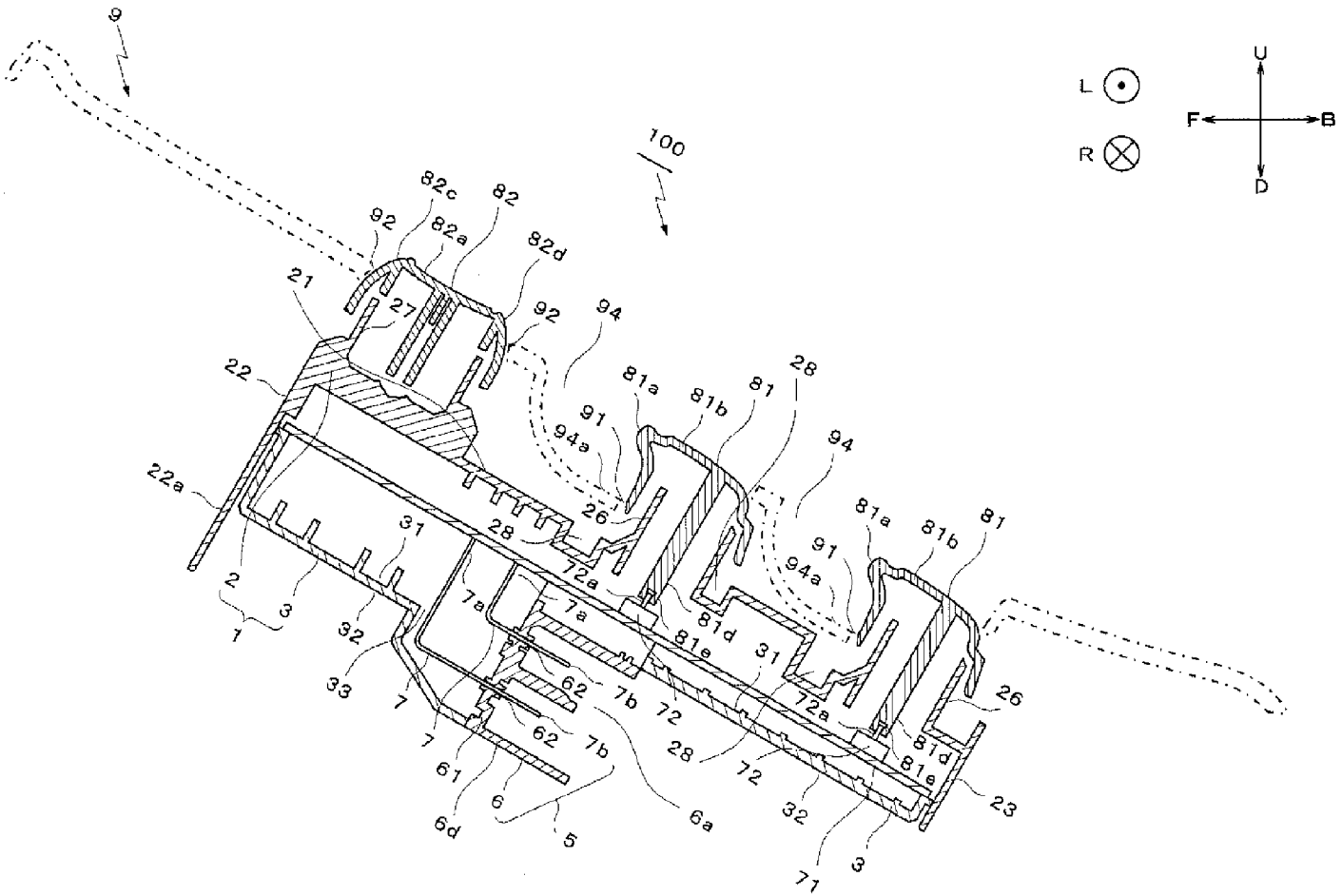
FIG. 10 is a lateral cross-sectional view of the same switch device attached in an inclined manner.

In the upper surface 21 of the upper case 2, tubular portions 26, a tubular portion 27, and groove portions 28 are provided (refer to FIG. 9).

The tubular portions 26 are each a void tube, which are vertically (in the U and D directions) open to communicate with an inside of the case 1. In outer side surfaces on right and left sides of each of these tubular portions 26, shafts 26*a* are formed integrally (FIG. 2). Although in FIG. 9, only the two tubular portions 26 are shown, actually, the four tubular portions 26 are provided, corresponding to the operation knobs 81, because the operation knobs 81 described later are attached thereto.

In FIG. 2, reference numerals 81 and 82 denote seesaw type operation knobs, and reference numeral 83 denotes a push type operation knob.

Particularly, a total of four operation knobs 81 are provided in the switch device 100, which are respectively operated, when respective windows of a driver seat, a front passenger seat, and right and left backseats are opened and closed.

In each of the operation knobs 81, reference numeral 81*a* denotes a throwing-out portion that throws out forward, reference numeral 81*b* denotes a cap portion formed integrally with the throwing-out portion 81*a*, and reference numeral 81*c* denotes a hole formed in a side wall of the cap portion 81*b*. The hole 81*c* is also formed in a side wall on an opposite side of the side wall formed with the above-mentioned hole 81*c*. That is, in each of the operation knobs 81, the two holes 81*c* are formed.

When each of the operation knobs 81 is attached to the tubular portion 26, the cap portion 81*b* of the operation knob 81 is put over the relevant tubular portion 26 so as to cover an upper opening of the tubular portion 26. Thereafter, the shafts 26*a* formed in the right and left outer side surfaces of the tubular portion 26 are fitted in the holes 81*c* formed in the side walls of the cap 81*b*. The above-described attachment allows the operation knob 81 to be supported by the tubular portion 26 in a state swingable in the front and back directions (F and B directions), centering on the shafts 26*a*.

81*d* penetrating the tubular portion 26 (refer to FIG. 9) denotes an operation rod formed so as to be integrally protruded inside the operation knob 81. This operation rod 81*d* penetrates the upper opening of the tubular portion 26 from the operation knob 81 and extends inside the case 1.

As shown in FIG. 9, in a lower end portion of the operation rod 81*d*, a depressed portion 81*e* is formed, and an actuator 72*a* of the switch 72 mounted on the printed circuit board 71 is fitted in this depressed portion 81*e*.

The switch 72 is the switch for window opening/closing, and, for example, is made of a publicly known slide switch. In place of the slide switch, the switch may be made up of a fixed contact point (illustration is omitted), formed on the printed circuit board 71, and a movable contact point (illustration is omitted) provided in the lower end portion of the operation rod 81*d*.

In the operation knob 81 having the above-described constitution, when the throwing-out portion 81*a* is pushed down or pulled up, the operation knob 81 rotates and swings back and forth, centering on the shafts 26*a*, so that the operation rod 81*d* transmits a motion of the operation knob 81 to the actuator 72*a* to turn on and off the switch 72. That is, the contact point provided inside the switch 72 is switched ON (conduction) or OFF (non-conduction) in accordance with an operation position of the operation knob 81. This allows the opening/closing operation of the window to be performed.

The operation knob 82 is operated when all doors for boarding are locked/unlocked. In the operation knob 82, reference numeral 82*a* denotes a cap portion, and reference numeral 82*b* denotes a hole formed in a side wall of the cap portion 82*a* (FIG. 2). The hole 82*b* is also formed in a side wall on an opposite side of the side wall formed with the above-mentioned hole 82*b*. That is, in the operation knob 82, the two holes 82*b* are formed.

Similar to the operation knob 81, by fitting the shafts 27*a* (FIG. 2) formed in the right and left outer side surfaces of the tubular portion 27 (FIG. 9) in the holes 82*b* formed in the side walls of the cap portion 82*a*, the operation knob 82 is supported by the tubular portion 27 in a state swingable in the front and back directions (F and B directions), centering on the shafts 27*a*.

In the operation knob 82 having the above-described constitution, when a front end portion 82*c* of the operation knob 82 is pushed down, all the doors for boarding are locked, and when a back end portion 82*d* of the operation knob 82 is pushed down, all the doors for boarding are unlocked.

While a switch operated by the operation knob 82 is mounted on the above-described printed circuit board 71, the illustration of the switch is omitted in FIG. 9.

The operation knob 83 is operated, when opening/closing control of the windows of the front passenger seat and the backseats is locked/unlocked. Particularly, when the operation knob 83 is operated to be pushed down, the opening/closing control of the above-described windows is locked, thereby disabling the opening/closing of the windows. Moreover, when the operation knob 83 is operated to be pushed up, the opening/closing control of the above-described windows is returned (unlocked), thereby enabling the opening/closing of the windows.

While in the upper surface 21 of the upper case 2, a tubular portion for attaching the operation knob 83 is also provided, the illustration thereof is omitted. Moreover, while a switch operated by the operation knob 83 is mounted on the above-described printed circuit board 71, the illustration of the switch is omitted in FIG. 9.

The groove portions 28 are provided in the vicinity of the tubular portions 26 (refer to FIGS. 2 and 9). These groove portions 28 each extend in the right and left directions (R and L directions) of the upper case 2, and end portions 28*a* on the side surface side (the right side surface 24, the left side surface 25) of the upper case 2 are open.

As shown in FIGS. 2 to 5, in the front surface 22 of the upper case 2, an extended portion 22*a* resulting from extending the front surface 22 downward (in the D direction) is provided. Moreover, as shown in FIGS. 3 to 7, in the right side surface 24 of the upper case 2, an extended portion 24*a* resulting from extending the right side surface 24 downward (in the D direction) is provided. Furthermore, as shown in FIGS. 2 to 6, and FIG. 8, in the left side surface 25 of the upper case 2, an extended portion 25*a* resulting from extending the left side surface 25 downward (in the D direction) is provided. These extended portions 22*a*, 24*a*, 25*a* are one example of an impervious wall according to one or more embodiments of the present invention. In one or more embodiments of the present invention, the above-described extended portions are formed integrally with the upper case 2. Moreover, the right side surface 24 having the extended portion 24*a* and the left side surface 25 having the extended portion 25*a* have the same size and shape.

Figure 4:
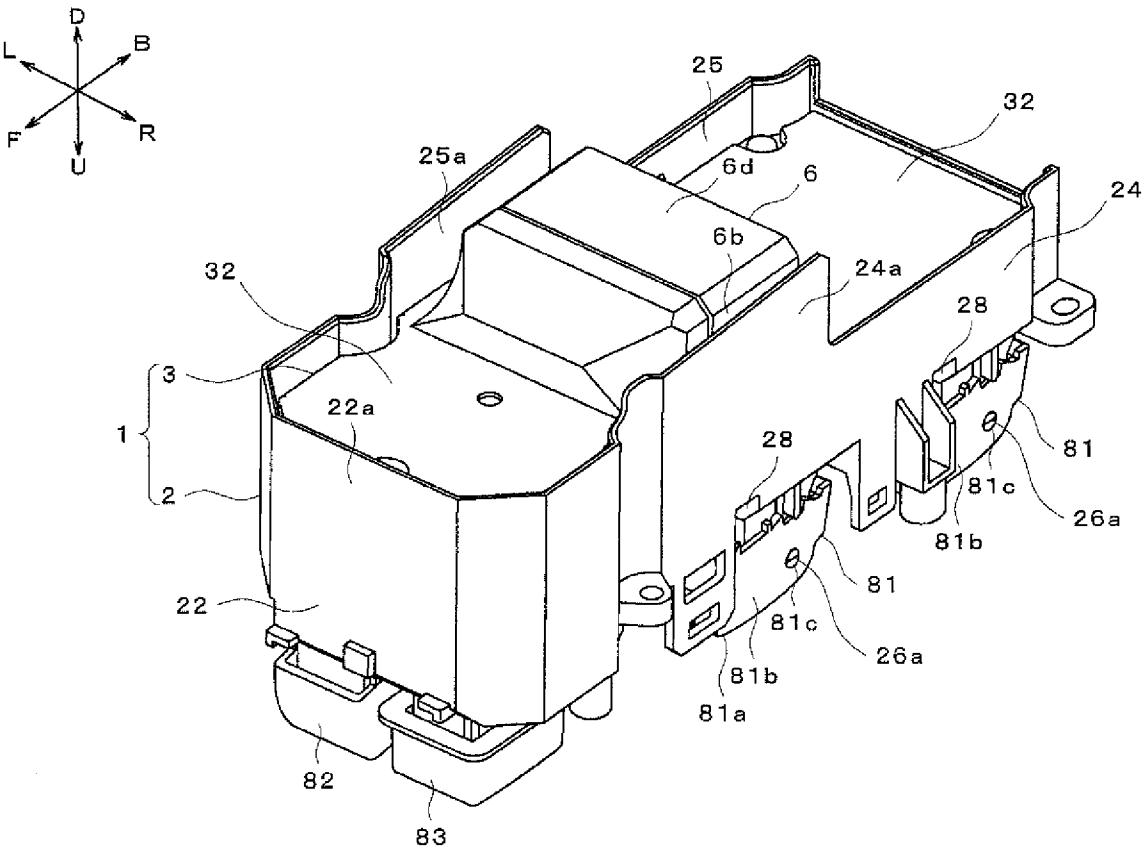
FIG. 4 is a perspective view when the switch device in FIG. 3 is viewed from a different direction.
Figure 6:
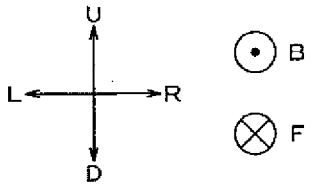
FIG. 6 is a back (rear) view of the switch device in FIG. 2.
Figure 6:
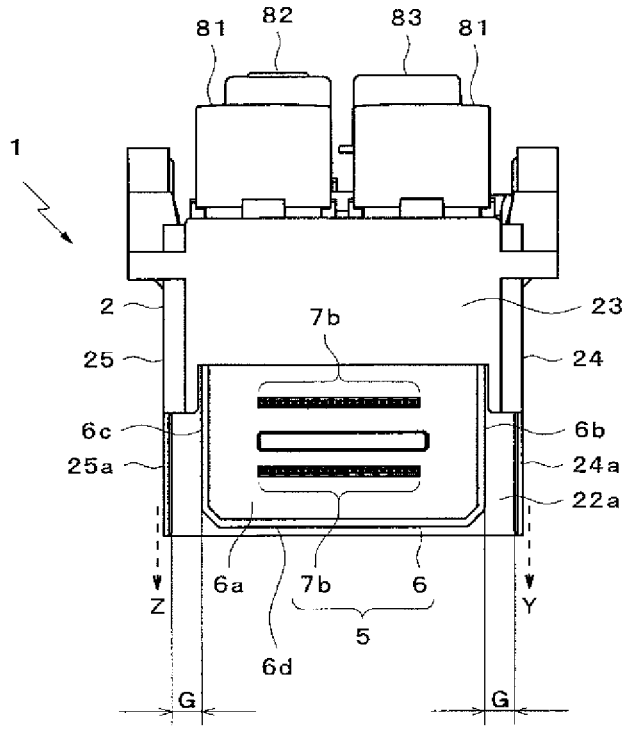
Figure 7:
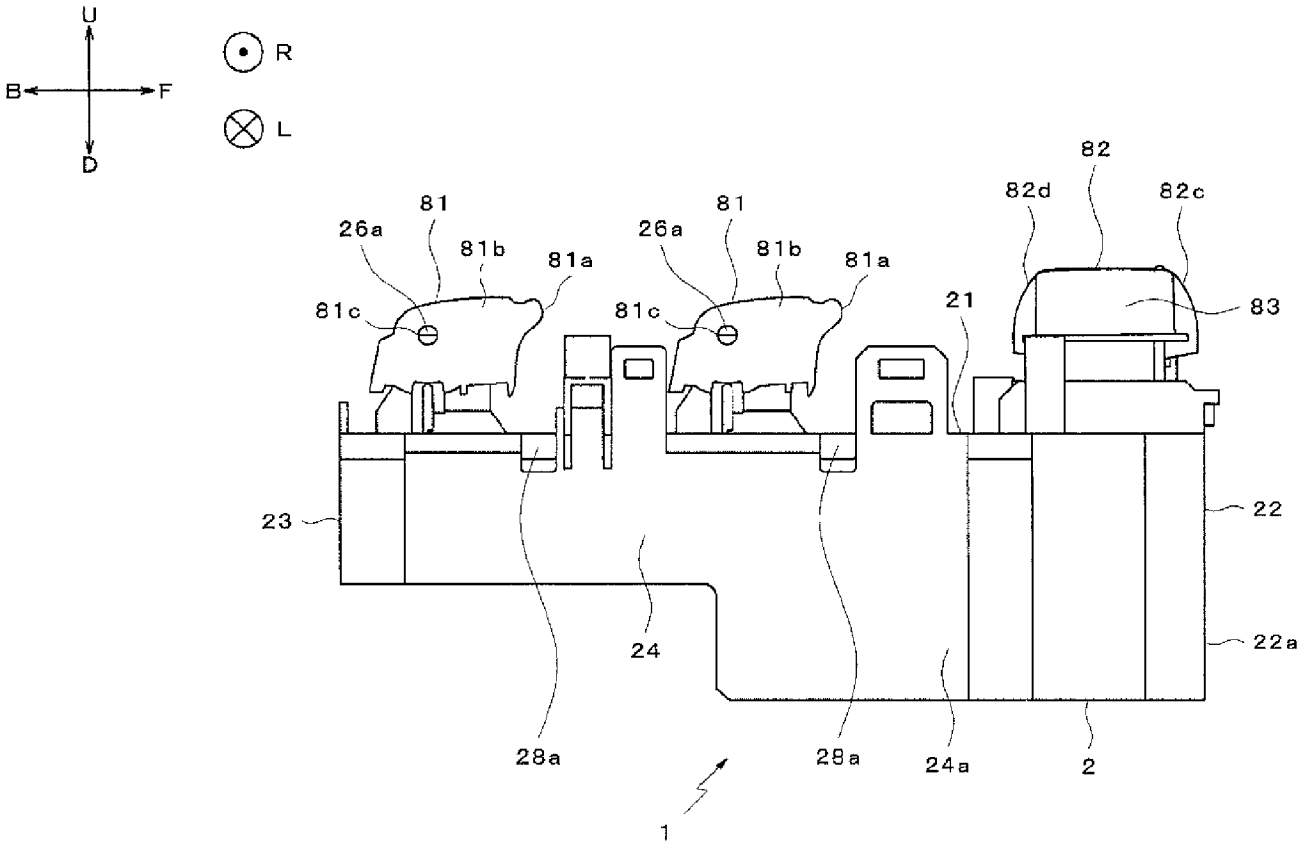
FIG. 7 is a right side view of the switch device in FIG. 2.
Figure 8:
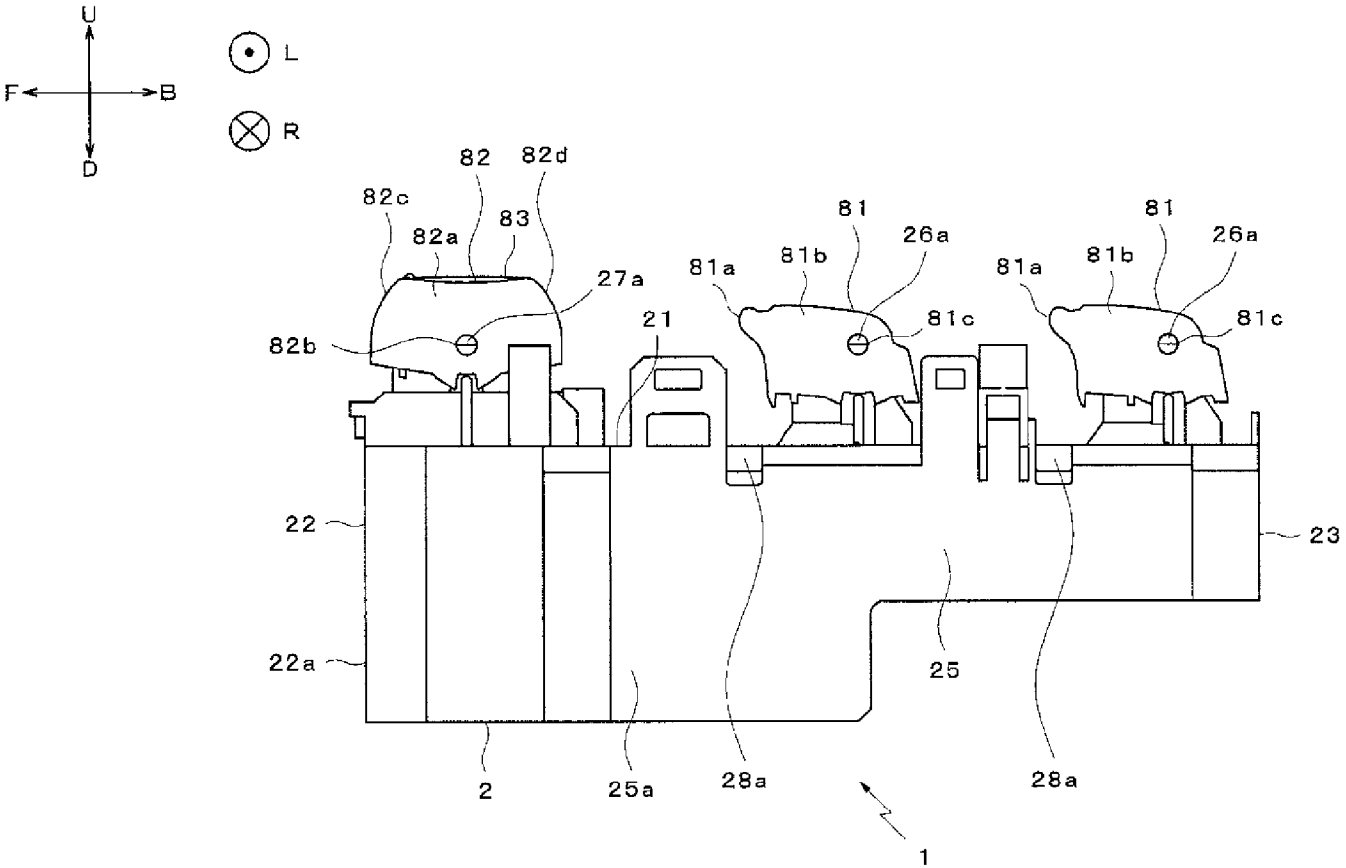
FIG. 8 is a left side view of the switch device in FIG. 2.

As shown in FIGS. 3 and 6, the extended portion 24*a* and the extended portion 25*a* are opposed to both side surfaces 6*b* and 6*c* of a housing 6 parallel to a leading-out direction (the B direction) of connection portions 7*b* of connection terminals described later. Moreover, as shown in FIGS. 3 and 4, these extended portions 24*a* and 25*a* cover both the side surfaces 6*b* and 6*c* of the housing 6 when viewed from the side surfaces 24 and 25 side (R and L directions) of the upper case 2. As shown in FIG. 6, the extended portions 24*a* and 25*a* are each arranged across a predetermined gap G from both the side surfaces 6*b* and 6*c* of the housing 6. Lower ends of the extended portions 24*a* and 25*a* extend slightly downward (in the D direction) with respect to a lower surface 6*d* of the housing 6.

Moreover, in one or more embodiments of the present invention, as described before, the groove portions 28 are provided in the upper surface 21 of the upper case 2 (FIGS. 2 and 9). These groove portions 28 are drainage channels for draining, to the sides of the side surfaces 24 and 25 of the upper case 2, water flowing down on the upper surface 21. The extended portion 24*a* is provided so as to be interposed between the groove portions 28 closer to the connector 5 and the connector 5 (FIGS. 3 and 4). The same is true in the extended portion 25*a*.

An extended portion 22*a* is provided continuously to the extended portions 24*a* and 25*a*, as shown in FIG. 3. These extended portions 22*a*, 24*a*, and 25*a* encompass three side surfaces of the housing 6 excluding an opening portion 6*a*.

As shown in FIG. 9, the printed circuit board 71 is placed on an upper surface 31 of the lower case 3. On an upper surface of this printed circuit board 71, the electronic components such as the switches 72 are mounted. Moreover, on a lower surface of the printed circuit board 71, the connector 5 is mounted.

The connector 5 has the housing 6 and the connection terminals 7 supported by this housing 6. The lower case 3 is formed with an opening portion 33, and the connector 5 is fitted in this opening portion 33 to be attached to the printed circuit board 71 with the housing 6 and the connection terminals 7 interposed therebetween.

The housing 6 has the opening portion 6*a* made of a depressed portion at one end portion in a direction parallel to a lower surface 32 of the lower case 3 (in the F and B directions in FIG. 9). Also, in another end portion of the housing 6 is formed a shielding wall 61 with through-holes 62 which the connection terminals 7 penetrate. One end portion 7*a* of each of the connection terminals 7 is connected to the printed circuit board 71 by soldering. Another end portion of each of the connection terminals 7 is led out to the opening portion 6*a* as a connection portion 7*b* through the through-hole 62 formed in the shielding wall 61.

A connector (illustration is omitted) with a cable to connect to a control device not shown is inserted and fitted in the opening portion 6*a* of the housing 6. This allows the connection portions 7*b* of the connector 5 and connection portions (illustration is omitted) of the counterpart connector to be connected, thereby enabling output signals of the switches 72 to be transmitted from the switch device 100 to the control device.

As shown in FIGS. 1 and 9, the cover 9 covers the upper surface 21 of the upper case 2 while exposing the respective operation knobs (the operation knobs 81 to 83).

In this cover 9, opening portions 91 where the operation knobs 81 are exposed, respectively, an opening portion 92 where the operation knob 82 is exposed, and an opening portion 93 where the operation knob 83 is exposed are formed (refer to FIG. 1).

Particularly, from the opening portions 92 and 93 in a first row, the operation knobs in the first row (the operation knobs 82 and 83) are exposed. From the opening portions 91 in a second row, the operation knobs in the second row (the two operation knobs 81) are exposed. From the opening portions 91 in a third row, the operation knobs in the third row (the two operation knobs 81) are exposed.

With each of the operation knobs 81, a finger is put on the throwing-out portion 81*a* to perform operation of pushing down or pulling up the throwing-out portion 81*a*. Therefore, depressed portions 94 are provided in the cover 9 for the purpose of making it easier to put the finger on the throwing-out portions 81*a*. The above-described opening portions 91 are each formed in a part of a bottom surface 94*a* of each of these depressed portions 94.

In the switch device 100 having the above-described structure is attached to the armrest of the door on the driver seat side, for example, in a state (refer to FIG. 10) where the front side of the switch device 100 is inclined upward (the U direction) at a predetermined angle (e.g., 20° to 30°) with respect to the ground (refer to FIG. 10) from a state shown in FIG. 9.

When in this state, a large quantity of water such as rainwater and drinkable water is poured over the cover 9, the water goes through gaps generated between the operation knobs 81 and the opening portions 91, a gap generated between the operation knob 82 and the opening 92 and the like, and flows into a space between the cover 9 and the upper case 2. The flowing-in water then flows down to the upper surface 21 of the upper case 2.

The water flowing down to the upper surface 21 of the upper case 2 flows in the front direction (the F direction), in the right and left directions (the R and L directions) of the upper surface 21, in the directions of the groove portions 28 provided in the upper surface 21 and the like, and flows down along the front surface 22, the right side surface 24, the left side surface 25 and the like of the upper case 2.

Figure 5:
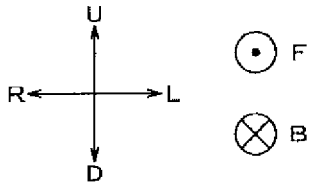
FIG. 5 is a front view of the switch device in FIG. 2.
Figure 5:
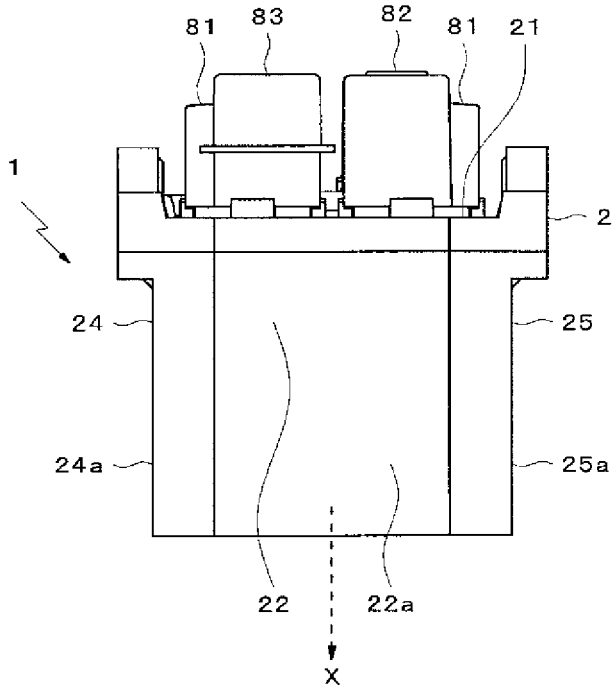

In the water flowing down to the upper surface 21 of the upper case 2, the flow to the connector 5 of the water flowing down along the front surface 22 of the upper case 2 is impeded by the extended portion 22*a*, so that the water drops from a lower end of the extended portion 22*a*, as indicated by dashed line arrow X in FIG. 5.

Moreover, the flow to the connector 5 of the water flowing down along the right side surface 24 of the upper case 2 is impeded by the extended portion 24*a*, and as indicated by dashed line arrow Y in FIG. 6, the water drops from a lower end of the extended portion 24*a*. Similarly, the flow to the connector 5 of the water flowing down along the left side surface 25 of the upper case 2 is impeded by the extended portion 25*a*, and as indicated by dashed line arrow Z in FIG. 6, the water drops from a lower end of the extended portion 25*a*.

Furthermore, the gaps G exist between the extended portions 24*a* and 25*a* and the housing 6, and thus, even if there are flows of the water trying to come around into the connector 5 side from the lower ends of the extended portions 24*a* and 25*a*, the water is shielded by the gaps G, and is impeded from coming around to the connector 5. Accordingly, the water does not come in from the opening portion 6*a* of the housing 6.

Moreover, the above-described gaps G are each set to enough a distance to prevent the water flowing down along the extended portions 24*a*, 25*a* from riding and moving to the housing 6 by surface tension. This can effectively prevent the water from coming around into the connector 5 by the surface tension.

Since by the foregoing, the flow to the connector 5 side of the water flowing down to the upper surface 21 of the upper case 2 is impeded by the extended portions 22*a*, 24*a*, and 25*a* provided in the front surface 22, the right side surface 24, and the left side surface 25 of the upper case 2, respectively, the water can be prevented from coming in from the opening portion 6*a* of the housing 6, thereby causing corrosion and a short circuit inside the connector 5.

Moreover, in the above-described switch 100, since the extended portions 22*a*, 24*a*, and 25*a* are formed integrally with the upper case 2, it is unnecessary to separately manufacture a component for shielding water and attach the same to the case 1. This can suppress an increase in number of components of the switch device 100, and reduce assembling manhours.

In the above-described switch device 100, the extended portions 22*a*, 24*a*, and 25*a* making up the impervious wall are provided so as to encompass the three side surfaces of the housing 6 excluding the opening portion 6*a* (FIGS. 3 and 4). Thereby, since the three sides of the connector 5 are surrounded by the impervious wall, the water can be more effectively prevented from coming into the connector 5 from the opening portion 6*a* of the housing 6.

Moreover, in the above-described switch device 100, the extended portions 24*a* and 25*a* are interposed between the groove portions 28 and the connector 5. Thus, even if the water is laterally drained from the groove portions 28 vigorously, the water is shielded by the extended portions 24*a* and 25*a*, which can impede the drained water from reaching the connector 5.

Furthermore, the above-described switch device 100, the lower ends of the extended portions 24*a* and 25*a* extend slightly downward with respect to the lower surface 6*d* of the housing 6 (FIG. 6). Therefore, the water dropping along the extended portions 24*a* and 25*a* does not fall on the side surfaces 6*b* and 6*c* of the housing 6, thereby increasing a waterproof effect of the connector 5.

A position of the lower ends of the extended portions 24*a* and 25*a* may be the same as a position of the lower surface 6*d* of the housing 6. This case can suppress a height of the extended portions 24*a* and 25*a* while maintaining the waterproof effect of the connector 5. This can lead to the downsizing of the switch device 100.

Subsequently, a switch device 200 according to a second embodiment of the present invention will be described with reference to FIGS. 11 to 14. In the following drawings, the same reference numerals are given to the same portions or corresponding portions.

In FIGS. 11 to 14, arrows U, D, F, B, R, and L indicate upper, lower, front, back, right and left directions of the switch device 200, respectively.

Figure 12:
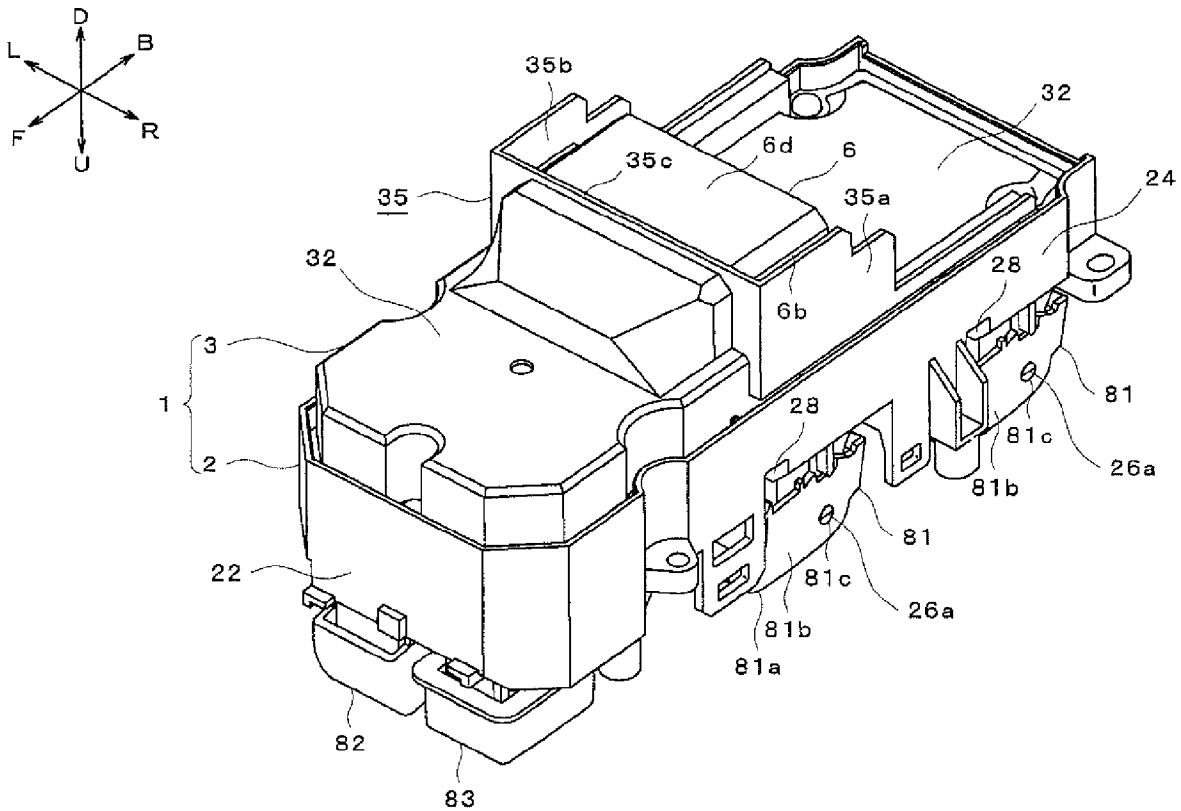
FIG. 12 is a perspective view when the switch device in FIG. 11 in a state where a cover is removed is viewed from beneath.
Figure 13:
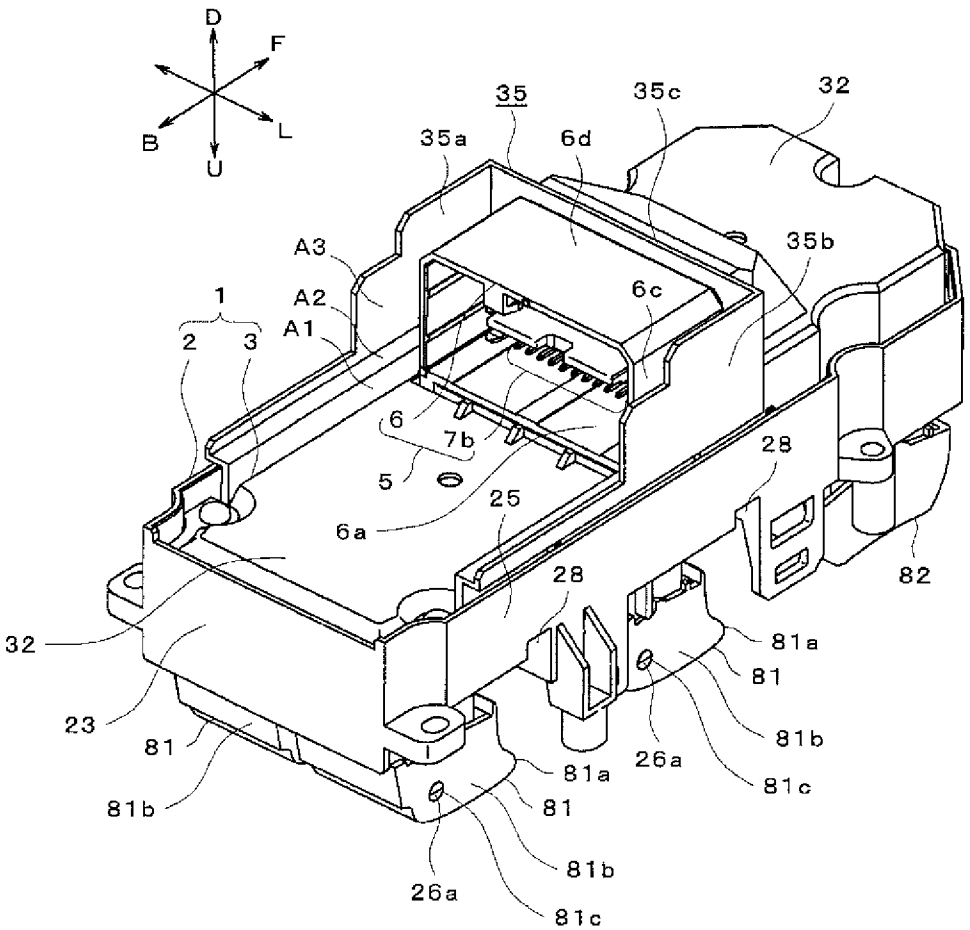
FIG. 13 is a perspective view when the switch device in FIG. 12 is viewed from a different direction.

While in the switch device 100 as the aforementioned first embodiment, the extended portions 22*a*, 24*a*, and 25*a* resulting from extending the upper case 2 downward function as the impervious wall, in the switch device 200 as the second embodiment, as shown in FIGS. 12 and 13, a wall portion 35 protruded from the lower surface 32 of the lower case 3 functions as the impervious wall. This wall portion 35 is formed integrally with the lower case 3 so as to extend downward (in the D direction), and is made up of three wall portions 35*a* to 35*c*.

Figure 14:
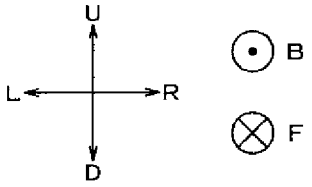
FIG. 14 is a back (rear) view of the switch device in FIG. 12.
Figure 14:
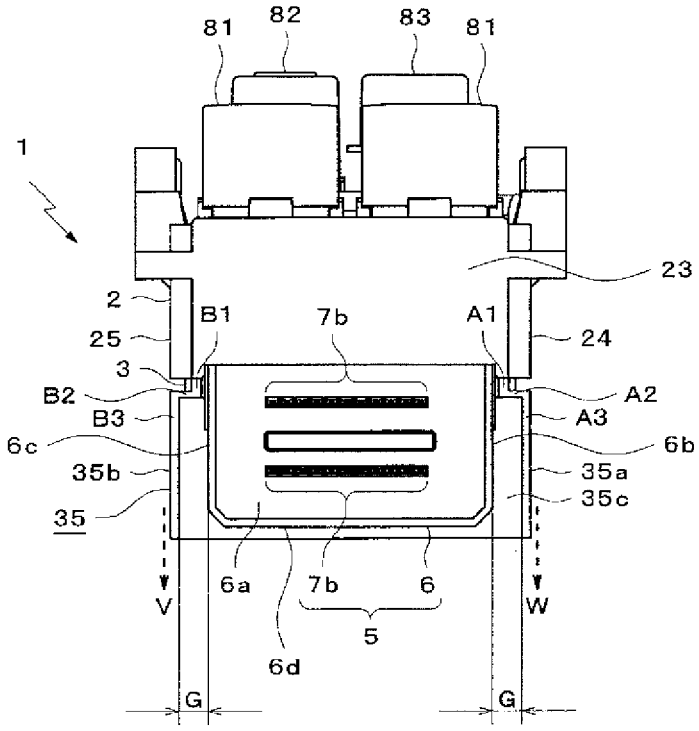

The wall portion 35*a* and the wall portion 35*b* are opposed to both the side surfaces 6*b* and 6*c* of the housing 6 parallel to the leading-out direction (the B direction) of the connection portions 7*b* of the connection terminals, as shown in FIGS. 13 and 14. Moreover, as shown in FIGS. 12 and 13, these wall portions 35*a* and 35*b* cover both the side surfaces 6*b* and 6*c* of the housing 6, when viewed from the sides of the side surfaces 24 and 25 (R and L directions) of the upper case 2. As shown in FIG. 14, the wall portions 35*a* and 35*b* are each arranged across a predetermined gap G from each of both the side surfaces 6*b* and 6*c* of the housing 6. Lower ends of the wall portions 35*a* and 35*b* extend slightly downward (in the D direction) with respect to the lower surface 6*d* of the housing 6. The same is true in a lower end of the wall portion 35*c*.

As shown in FIGS. 13 and 14, the wall portion 35*a* is made up of a first portion A1 that perpendicularly rises adjacent to the upper case 2 from the lower surface 32 of the lower case 3, a second portion A2 extending from this first portion A1 to the side surface 24 side of the upper case 2 so as to be parallel to the lower surface 32, and a third portion A3 that rises perpendicular to the lower surface 32 from an end portion on the side surface 24 side of this second portion A2. As shown in FIG. 14, a side surface of the third portion A3 is on the same level as the side surface 24 of the upper case 2.

The wall portion 35*b*, as shown in FIG. 14, is also made up of a first portion B1, a second portion B2 and a third portion B3 corresponding to the first portion A1, the second portion A2, and the third portion A3 of the wall portion 35*a*. A side surface of the third portion B3 is on the same level as the side surface 25 of the upper case 2.

Moreover, in one or more embodiments of the present invention, the groove portions for drainage 28 are formed in the upper surface 21 of the upper case 2, and the wall portions 35*a* and 35*b* are provided between the groove portions 28 closer to the connector 5 and the connector 5 (FIGS. 12 and 13).

The wall portion 35*c* is arranged adjacent to the housing 6 on the opposite side of the opening portion 6*a*, as shown in FIG. 13. Therefore, the wall portion 35 encompasses the three side surfaces of the housing 6 excluding the opening portion 6*a* by the respective wall portions (35*a* to 35*c*).

Since the connector 5, the internal structure of the case 1, the operation knobs 81 to 83, the cover 9 and the like are similar to those in the first embodiment, descriptions thereof are omitted.

Figure 11:
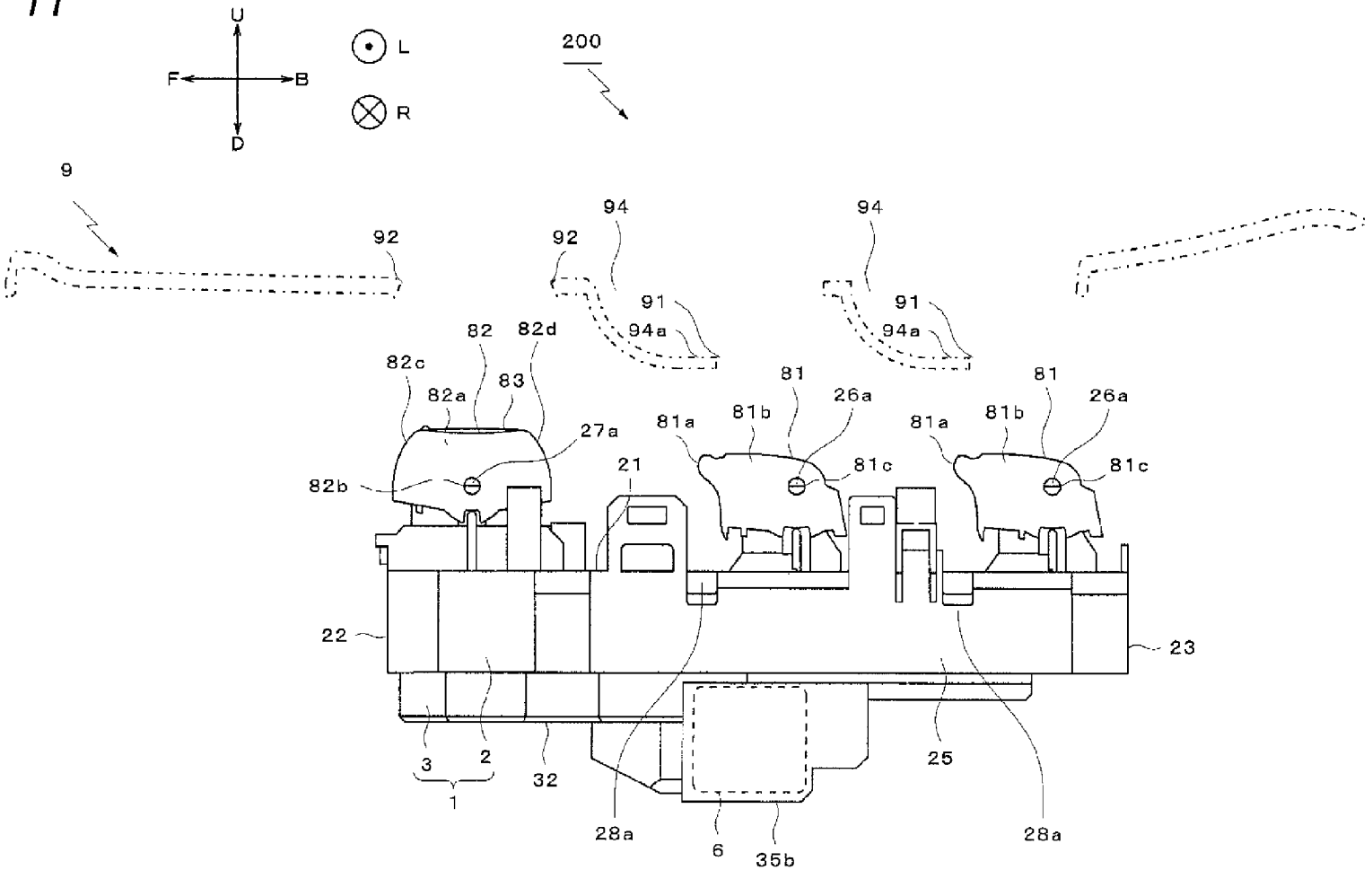
FIG. 11 is a left side view of a switch device according to a second embodiment of the present invention.

The switch device 200 having the above-described structure is attached to the armrest of the door on the driver seat side, for example, in a state where the front side of the switch device 200 is inclined upward (in the U direction) at a predetermined angle (e.g., 20° to 30°) with respect to the ground from a state shown in FIG. 11.

When in this state, a large quantity of water such as rainwater and drinkable water is poured over the cover 9, the water goes through gaps generated between the operation knobs 81 and the opening portions 91, a gap generated between the operation knob 82 and the opening 92 and the like, and flows into a space between the cover 9 and the upper case 2. The flowing-in water then flows down to the upper surface 21 of the upper case 2.

The water flowing down to the upper surface 21 of the upper case 2 flows in the front direction (the F direction), in the right and left directions (the R and L directions) of the upper surface 21, in the directions of the groove portions 28 provided in the upper surface 21, and the like, and flows down along the front surface 22, the right side surface 24, the left side surface 25 and the like of the upper case 2.

In the water flowing down to the upper surface 21 of the upper case 2, the water flowing down along the front surface 22 of the upper case 2 drops from a lower end of the front surface 22. Moreover, even if a part of the water flowing down on the front surface 22 heads for the connector 5 side along the lower surface 32 of the lower case 3, this water is impeded by the wall portion 35*c* from reaching the connector 5.

Moreover, the flow to the connector 5 of the water flowing down along the right side surface 24 of the upper case 2 is impeded by the wall portion 35*a*, and as indicated by dashed line arrow W in FIG. 14, the water drops from a lower end of the wall portion 35*a*. Similarly, the flow to the connector 5 of the water flowing down along the left side surface 25 of the upper case 2 is impeded by the wall portion 35*b*, and as indicated by dashed line arrow V in FIG. 14, the water drops from a lower end of the wall portion 35*b*.

Furthermore, the gaps G exist between the wall portions 35*a* and 35*b* and the housing 6, and thus, even if there are flows of the water trying to come around into the connector 5 side from the lower ends of the wall portions 35*a* and 35*b*, this water is shielded by the gaps G, and is impeded from coming around to the connector 5. Accordingly, the water does not come in from the opening portion 6*a* of the housing 6.

Moreover, the above-described gaps G are each set to enough a distance to prevent the water flowing down along the wall portions 35*a* and 35*b* from riding and moving to the housing 6 by surface tension. This can effectively prevent the water from coming around into the connector 5 by the surface tension.

Since by the foregoing, the flow to the connector 5 side of the water flowing down to the upper surface 21 of the upper case 2 is impeded by the wall portion 35 protruded from the lower surface 32 of the lower case 3, the water can be prevented from coming in from the opening portion 6*a* of the housing 6, thereby causing corrosion and a short circuit inside the connector 5.

Moreover, in the above-described switch 200, since the wall portion 35 is formed integrally with the lower case 3, it is unnecessary to separately manufacture a component for shielding water and attach the same to the case 1. This can suppress an increase in number of components of the switch device 200, and reduce assembling manhours.

Moreover, in the above-described switch device 200, the wall portion 35 making up the impervious wall is provided so as to encompass the three side surfaces of the housing 6 excluding the opening portion 6*a* (FIGS. 12 and 13). Thereby, since the three sides of the connector 5 are surrounded by the impervious wall, the water can be effectively prevented from coming into the connector 5 from the opening portion 6*a* of the housing 6.

Moreover, in the above-described switch device 200, the wall portions 35*a* and 35*b* are interposed between the groove portions 28 and the connector 5. Thus, even if the water is laterally drained from the groove portions 28 vigorously, the water is shielded by the wall portions 35*a* and 35*b*, which can impede the drained water from reaching the connector 5.

Moreover, in the above-described switch device 200, as shown in FIG. 14, the side surfaces of the respective third portions A3 and B3 of the wall portions 35*a* and 35*b* are on the same level as the side surfaces 24 and 25 of the upper case 2. Thereby, when the wall portion 35 as the imperious wall is provided in the lower case 3 as well, the gaps G comparable to the case where the side surfaces 24 and 25 of the upper case 2 are extended to make up the impervious wall can be assured between both the side surfaces 6*b* and 6*c* of the housing 6 and the wall portions 35*a* and 35*b*.

Furthermore, in the above-described switch device 200, the lower ends of the wall portions 35*a* and 35*b* extend slightly downward with respect to the lower surface 6*d* of the housing 6 (FIG. 14). Therefore, the water dropping along the wall portions 35*a* and 35*b* does not fall on the side surfaces 6*b* and 6*c* of the housing 6, thereby increasing a waterproof effect of the connector 5.

A position of the lower end of the wall portion 35 may be the same as the position of the lower surface 6*d* of the housing 6. This case can suppress the height of the wall portion 35 while maintaining the waterproof effect of the connector 5. This can lead to the downsizing of the switch device 200.

In the present invention, various embodiments other than the above-described embodiments can be employed.

Figure 15:
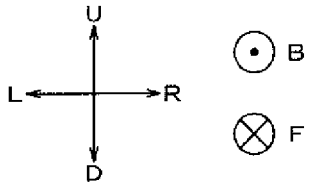
FIG. 15 is a back (rear) view showing a modification of the first embodiment.
Figure 15:
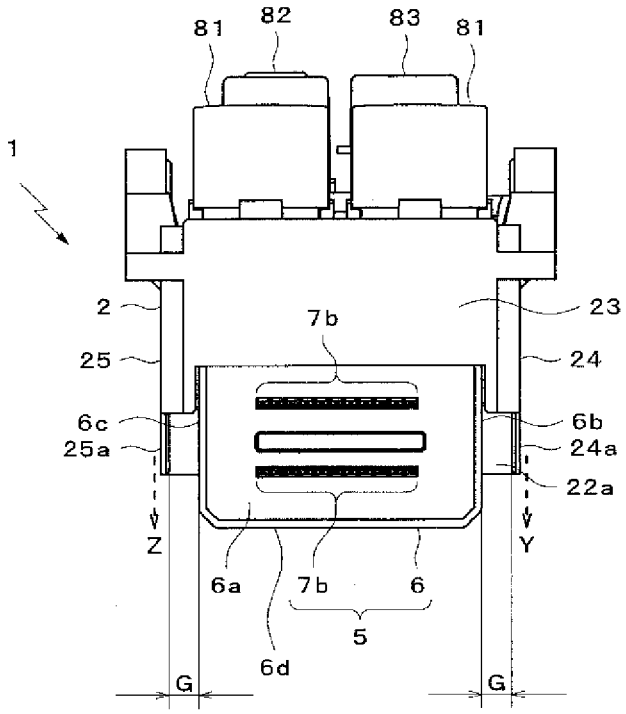

For example, in the first embodiment, the case where the position of the lower ends of the extended portions 24*a* and 25*a* are the same as, or lower than the position of the lower surface 6*d* of the housing 6 (FIG. 6) is exemplified. However, in the present invention, as shown in FIG. 15, the position of the lower ends of the extended portions 24*a* and 25*a* may be upper than the position of the lower surface 6*d* of the housing 6. In this case, the gaps G can also prevent the water from coming around into the connector 5 from the extended portions 24*a* and 25*a*.

Figure 16:
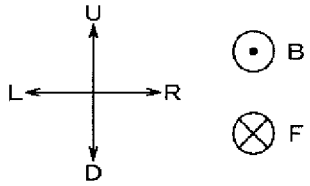
FIG. 16 is a back (rear) view showing a modification of the first embodiment.
Figure 16:
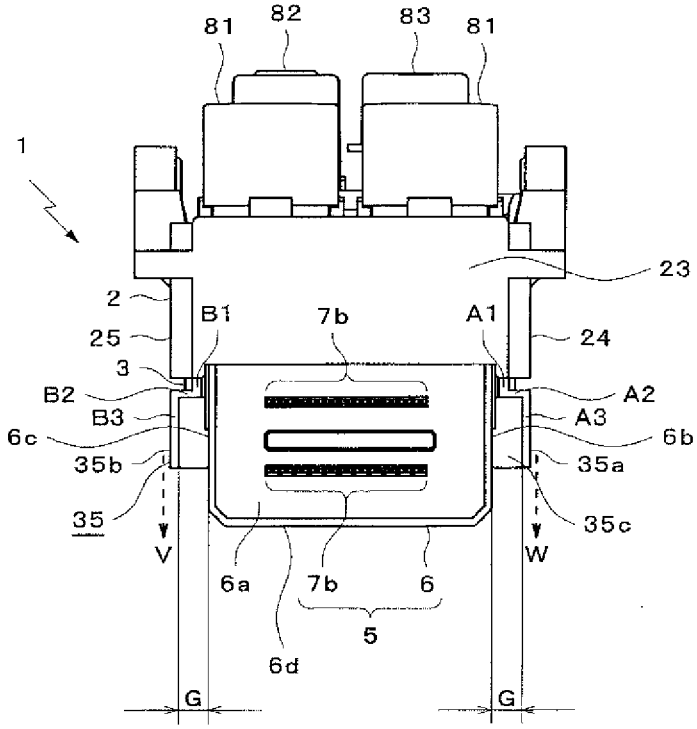
Figure 17:
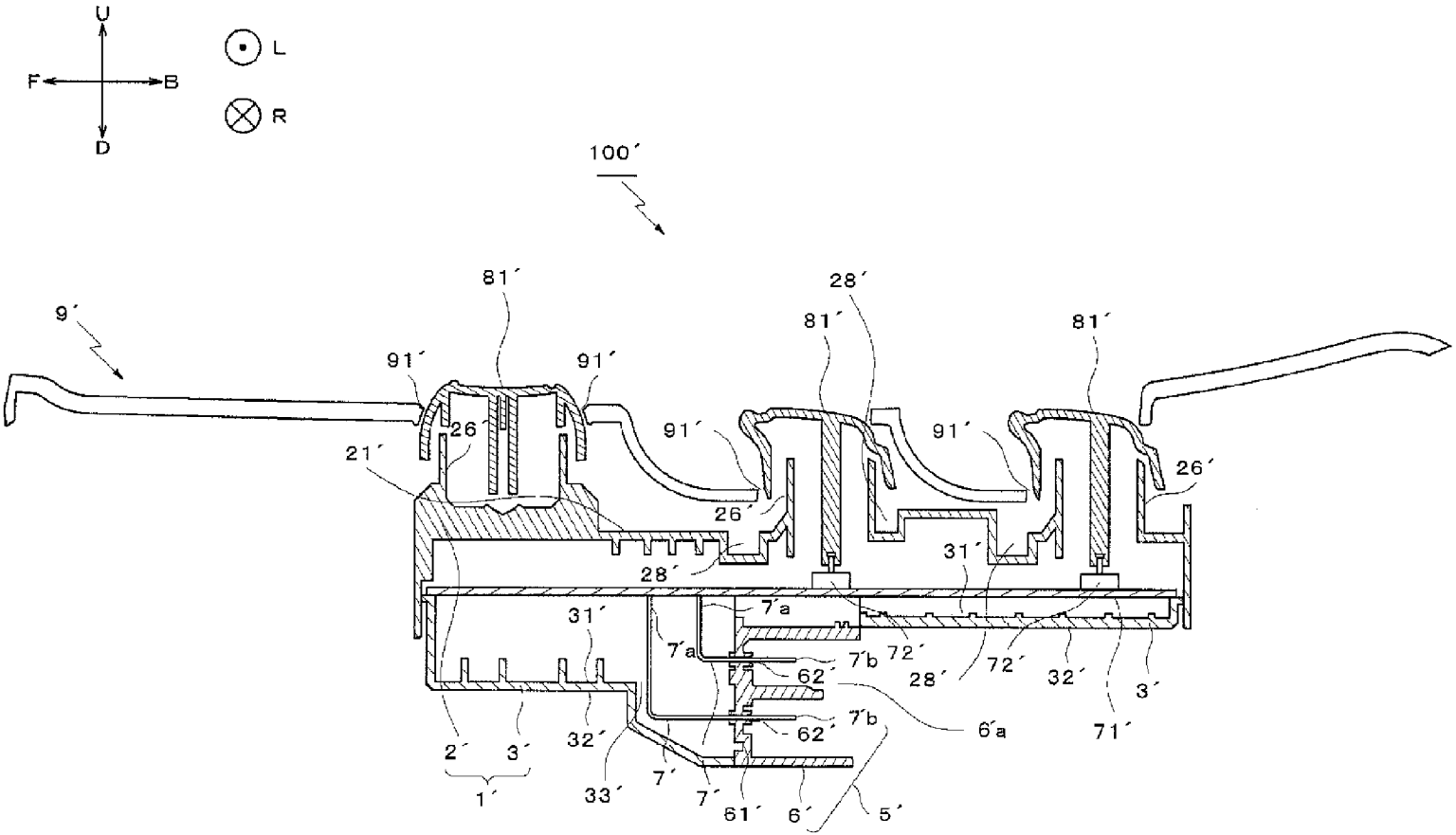
FIG. 17 is a lateral cross-sectional view of a conventional switch device.
Figure 18:
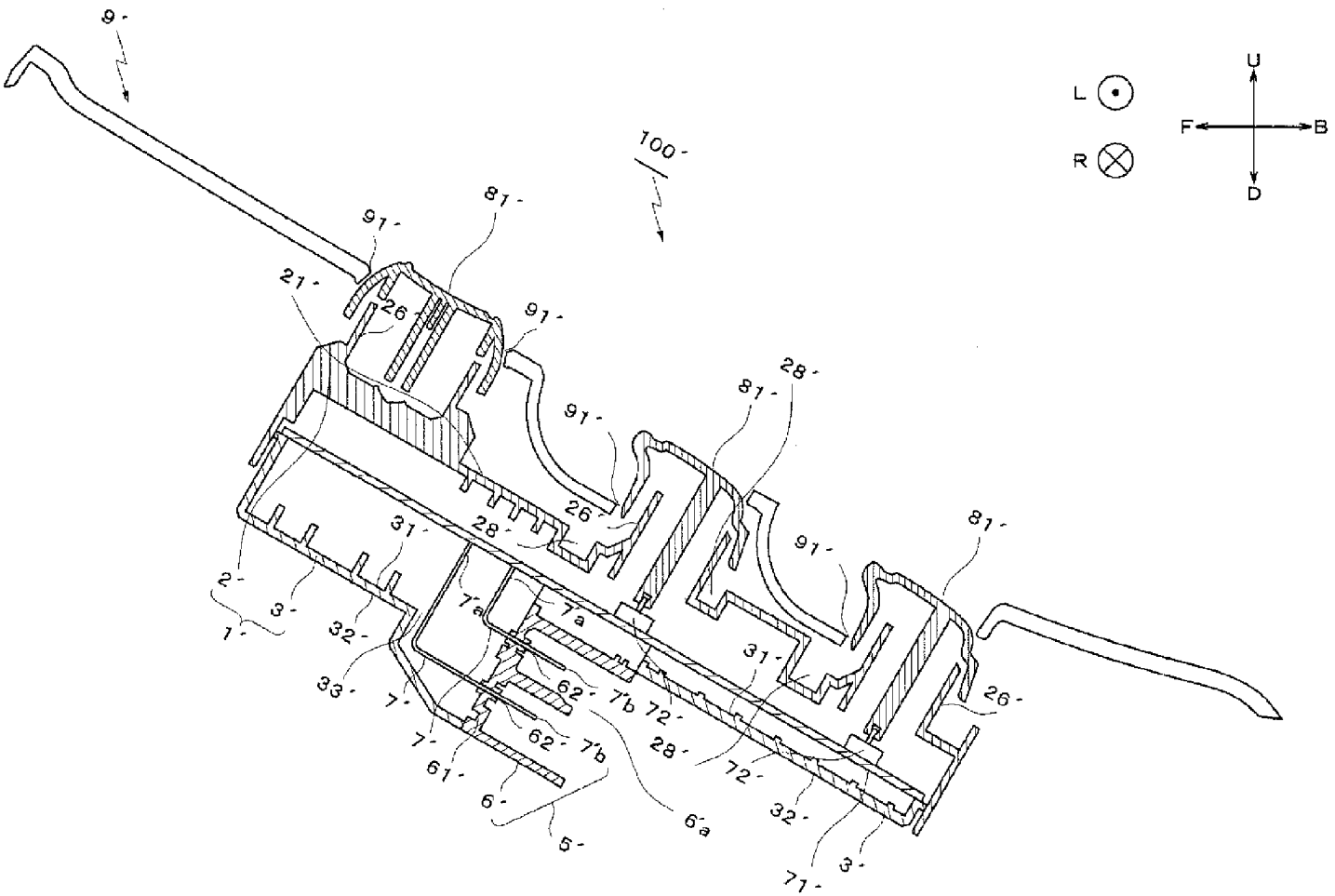
FIG. 18 is a lateral cross-sectional view of the conventional switch device attached in an inclined manner.

Similarly, in the second embodiment, the case where the position of the lower end of the wall portion 35 is the same as, or lower than the position of the lower surface 6*d* of the housing 6 (FIG. 14) is exemplified. However, in the present invention, as shown in FIG. 16, the position of the lower end of the wall portion 35 may be upper than the position of the lower surface 6*d* of the housing 6. In this case, the gaps G can also prevent the water from coming around into the connector 5 from the wall portions 35*a* and 35*b*.

Moreover, while in the first embodiment, in FIG. 9, the case is exemplified where the opening portion 6*a* of the housing 6 of the connector 5 is opened in the direction parallel to the lower surface 32 of the lower case 3 (in the B direction), the opening portion 6*a* of the housing 6 may be open in the D direction in FIG. 9. The same is true in the second embodiment.

In the above-described first and second embodiments, the cases are exemplified where embodiments of the present invention is applied to the switch device 100 and the switch device 200 used in a power window apparatus with four window opening/closing switches provided. However, embodiments of the present invention can be applied to a switch device where four or more window opening/closing switches are provided, a switch device used in a door opening/closing apparatus, and so on. Moreover, embodiments of the present invention can be applied to a switch device used for a purpose other than vehicle.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A switch device comprising:

a case;

an operation knob disposed above the case; and a connector disposed under the case, wherein the connector has connection terminals and a housing supporting the connection terminals, the housing being formed with an opening portion from which the connection terminals are led out, wherein the case is provided with an impervious wall extending downward from the case so as to be opposed to both side surfaces of the housing parallel to a leading-out direction of the connection terminals, and wherein the impervious wall is arranged across a gap from each of the both side surfaces of the housing.

2. The switch device according to claim 1, wherein the impervious wall is formed integrally with the case.

3. The switch according to claim 2, wherein the case comprises:

an upper case having an opening facing downward, and a lower case attached to the upper case so as to shut the opening of the upper case, and wherein the impervious wall comprises extended portions resulting from extending both side surfaces of the upper case downward.

4. The switch according to claim 2, wherein the case comprises:

an upper case having an opening facing downward, and a lower case attached to the upper case so as to shut the opening of the upper case, and wherein the impervious wall comprises a wall portion that is protruded downward from a lower surface of the lower case.

5. The switch device according to claim 4, wherein the wall portion comprises:

a first portion perpendicularly rising from the lower surface of the lower case, a second portion extending to a side surface side of the upper case parallel to the lower surface of the lower case from the first portion, and a third portion rising perpendicular to the lower surface of the lower case from an end portion on the side surface side of the second portion, and wherein a side surface of the third portion is on the same level of the side surface of the upper case.

6. The switch device according to claim 1, wherein the housing has the opening portion in one end portion in the direction parallel to the lower surface of the case, and wherein the impervious wall is provided so as to encompass threes side surfaces of the housing excluding the opening portion.

7. The switch device according to claim 1, wherein a groove portion for draining, to the side surface side of the case, water flowing down to the upper surface of the case is provided in the upper surface of the case, and wherein the impervious wall is interposed between the groove portion and the connector.

8. The switch device according to claim 1, wherein a position of a lower end of the impervious wall is the same as, or lower than a position of a lower surface of the housing.

* * * * *